US005259731A

United States Patent [19]

Dhindsa et al.

[11] Patent Number: 5,259,731

[45] Date of Patent: Nov. 9, 1993

[54] MULTIPLE RECIPROCATING PUMP SYSTEM

[76] Inventors: Jasbir S. Dhindsa, 1239 Sugarcreek Blvd., Sugarland, Tex. 77478; Hector C. Arambula, 2517 Sage Brush La., Sugarland, Tex. 77079

[21] Appl. No.: 690,074

[22] Filed: Apr. 23, 1991

[51] Int. Cl.[5] ..... F04B 41/06

[52] U.S. Cl. ..... 417/3; 417/5; 417/7; 417/45; 417/53; 417/63; 417/6; 417/900

[58] Field of Search ..... 417/3, 5, 7, 45, 53, 417/63, 900, 6, 539

[56] References Cited

U.S. PATENT DOCUMENTS

| | | | |
|---|---|---|---|
| 3,364,871 | 1/1968 | Wilson | 417/539 |
| 3,667,869 | 6/1972 | Schlecht | 417/539 |
| 3,940,184 | 2/1976 | McCain | 417/43 |
| 4,269,569 | 5/1981 | Hoover | 417/5 |
| 4,497,614 | 2/1985 | Frink | 417/238 |
| 4,527,954 | 7/1985 | Murali et al. | 417/346 |
| 5,064,353 | 11/1991 | Tsukahara | 417/45 |

*Primary Examiner*—Richard A. Bertsch
*Assistant Examiner*—David W. Scheuermann

[57] ABSTRACT

The present invention discloses a system for pumping a fluid into a common pressure outlet. The system contains a plurality of reciprocating pumps. A separate sensor coupled to one cylinder of each pump provides an electrical signal each time the piston in that cylinder is at a predetermined position. A speed control circuit is provided to independently adjust the speed of each pump. Manual speed control for each pump is provided through a separate throttle for each pump. A pump control circuit coupled to each of the throttles, sensors and speed control circuit controls the operation of the system. An operator determines which of the pumps to operate by closing appropriate bypass switches provided at the pump control circuit, turns on the first (master) pump and adjusts its associated throttle to operate the pump at a desired speed. The operator then turns on each of the remaining (slave) pumps. The pump control circuit utilizing the information from each of the sensors provides control signals to the speed control circuit, which adjusts the speed of each of the slave pumps to synchronize the speeds of pumps and to maintain a desired phase shift between the sensor signals. The system also displays the speed of each of the operating pumps and the total fluid volume being discharged by all of the operating pumps.

17 Claims, 7 Drawing Sheets

MULTIPLE RECIPROCATING PUMP SYSTEM

BACKGROUND OF THE INVENTION

1. Field of the Invention

This invention generally relates to a system utilizing multiple reciprocating pumps for pumping a fluid into a common pressure outlet and more particularly to an apparatus and method for controlling the phase shift between the strokes of the pistons of the pumps to operate the pumps at desired speeds.

2. Background of the Related Art

Large reciprocating pumps are frequently used to pump a fluid from a source into a common pressure outlet or manifold. The reciprocating pumps contain one or more than one cylinders, each having a piston reciprocating therein. The pistons are moved (stroked inside their respective cylinders) by a prime mover coupled to a crank shaft to pump the fluid into the manifold. The speed of a piston and the pressure exerted by it on the fluid being pumped by it varies as it reciprocates within its respective cylinder. Variable speed a.c. motors, d.c. motors, diesel/gasoline engines, hydraulic systems or the like are usually used as prime movers.

In the oil and gas industry, two or more large electric pumps, each usually larger than 750 horse-power capacity, are frequently used to pump a fluid from a source into a common pressure outlet, from where it is discharged into a well while such well is being drilled. The fluid commonly used is a mixture of mud, oil, water and other materials. Such a fluid is generally referred to as the "mud," and the pumps used therefore are referred to as the "mud pumps." The majority of mud pumps currently used in the industry contain three cylinders and cost more than one hundred thousand dollars ($100,000.00) each.

Typically, all mud pumps supply the fluid into a common pressure outlet or manifold or pipe, from where the fluid is discharged into the well. The speed of each pump is separately controlled by controlling the speed of the prime mover. When electric motors are utilized as prime movers, their speeds are adjusted by varying the power to the motors. In a typical multiple mud pump system used in the oil and gas industry, an operator endeavors to set the speed of each pump the same by manually adjusting a separate throttle for each motor, which as a practical matter is rarely achieved. Further, no means exists to control the phase shift between the strokes of the pistons of different pumps.

The difference in the number of strokes of the mud pumps is generally termed as the beat frequency. The presence of a beat frequency and varying phase shift between the strokes of the pistons of the pumps cause the pressure in the manifold to vary significantly during each pump system cycle. The fluctuations in the pressure (the pressure ripples) cause fatigue on the pump seals, pump valves, output side hydraulic system, flexible hoses, and other parts related to the mud pumps, causing such elements to wear out quickly, greatly reducing the working life of the mud pumps and related devices in the output hydraulic system. Any breakdown of a mud pump or the related parts may require shutting down the drilling operation until the broken mud pump or the part is either repaired or replaced. Such a shutdown can be very expensive, especially for off-shore drilling operations because it costs several thousand dollars for each hour of down-time.

In state of the art drilling of oil and gas wells, well logging tools and other equipment are connected to the drill pipe near the drill bit for determining the presence of hydrocarbons, various geological parameters such as pressure, temperature etc. and other information. These tools contain a variety of sensors and electronics to process electrical signals. The electrical signals are usually transmitted up-hole through the drilling mud. Any unpredictable pressure variation in the mud column may introduce noise into the transmitted signal, which may degrade the quality of the signal being transmitted through the mud column or may require the use of additional circuitry or software to process the signals. Thus, the overall reduction of the pressure ripple (pressure fluctuation) and the elimination of the beat frequency allows better transmission of the signals through the mud column.

The present invention addresses the above noted shortcomings of the prior art pump systems and provides a multiple pump system wherein the speed of each pump is controlled by maintaining the desired phase shifts between strokes of the pistons of different mud pumps.

SUMMARY OF THE INVENTION

A multiple reciprocating pump system for discharging a fluid into a common pressure manifold is disclosed. Each pump has an associated sensor for providing a signal indicative of the operating cycle of its associated pump with respect to the operating cycle of the pump system. A control circuit is coupled to each sensor and each pump. The control circuit adjusts the speed of the pumps to operate the pumps synchronously and to a maintain desired phase shift between the sensor signals.

Examples of more important features of the invention thus have been summarized rather broadly in order that the detailed description thereof that follows may be better understood, and in order that the contributions to the art may be better appreciated. There are, of course, many additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawings, in which like elements have been given like numerals and wherein.

DESCRIPTION OF THE PREFERRED EMBODIMENT

Figure 1:
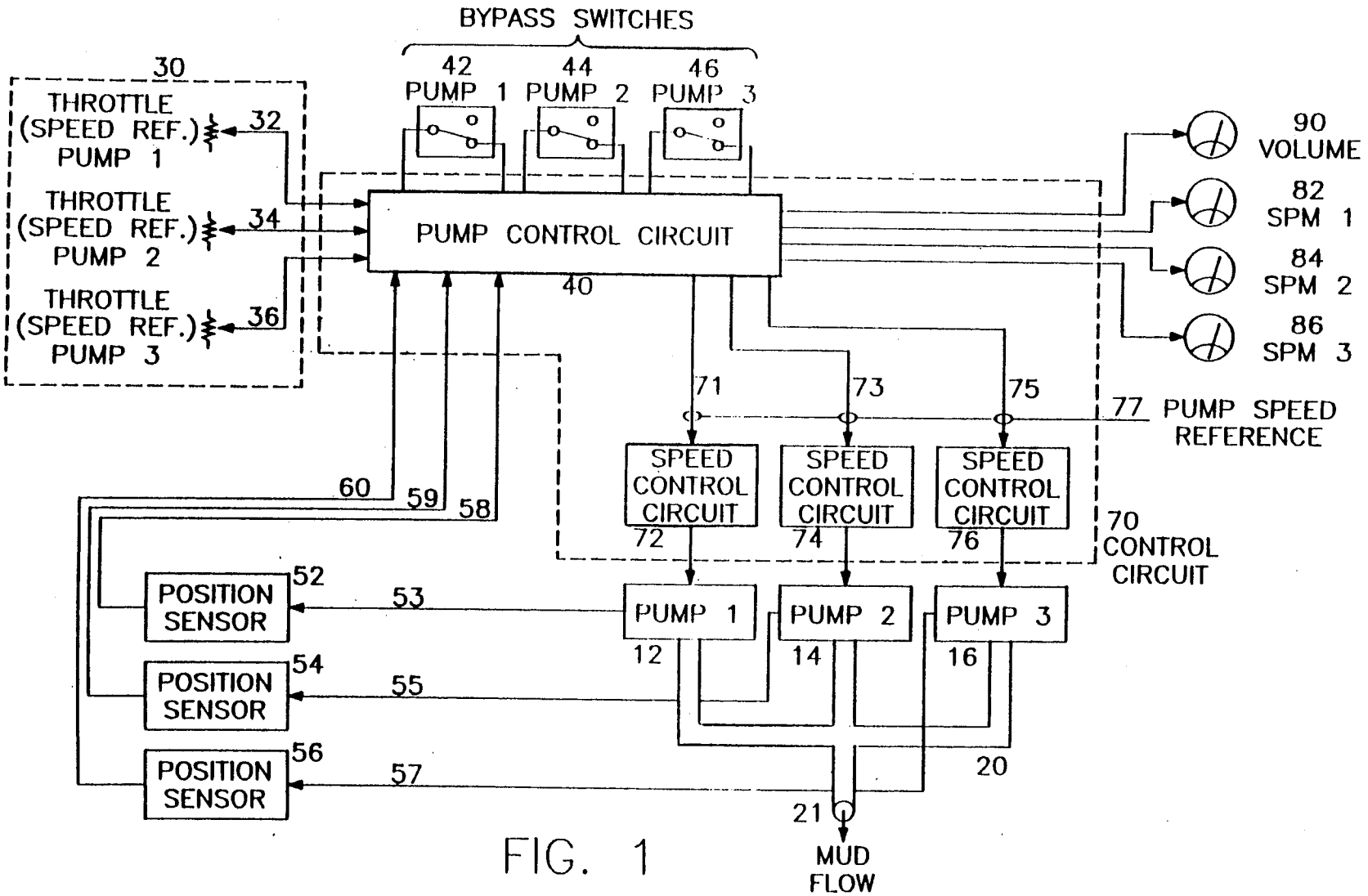
FIG. 1 Shows a functional block diagram of the system of the present invention.

FIG. 1 shows the functional block diagram of the system of the present invention. The system includes a plurality of reciprocating pumps, wherein each pump has an associated position sensor, a speed control circuit, a throttle, a bypass switch, and a pump speed indicator, and a common pump control circuit for controlling the operation of the system.

In the field of oil and gas exploration, large reciprocating pumps—generally pumps having greater than 750 horse-power capacity—are used for pumping a fluid into a well while it is being drilled. The fluid used is typically made from a mixture of mud, water, oil and other materials to obtain desired density, viscosity and other properties. The fluid is commonly referred to as the "mud" and the pumps used to pump the mud are referred to as the "mud pumps." In a majority of the cases, either two or three pumps are used together to pump mud into a common pipe or manifold. However, one pump or more than three pumps are also used. Additionally, majority of the commercially available pumps contain three pistons each. Therefore, for convenience, FIG. 1 is shown to have three pumps, although the present invention is equally applicable to any multi-pump system. Further, for most of the description that follows, each pump is assumed to contain three cylinders, even though the present invention is equally applicable to a system in which different pumps may have the same or different number of cylinders.

The system, as shown in FIG. 1, contains three reciprocating pumps 12, 14 and 16. Each pump pumps the fluid from a source (not shown) into a common pressure outlet or manifold 20, from where the fluid is discharged into a well via a pipe 21. A separate position sensor is installed in one of the cylinders of each pump. Position sensors 52, 54 and 56 are respectively installed in pumps 12, 14 and 16. Each position sensor, provides an electrical signal when the piston in that cylinder is at a predetermined location. The sensor signals are used to determine the operating cycle of each pump with respect to the operating cycle of the pump system. Typically, the position sensor is installed in the cylinder in a manner so that it provides a signal each time the piston in that cylinder is at or near the end of its travel toward the cylinder head. Each position sensor is operatively coupled to and provides the signals to a pump control circuit 40, which controls the operation of the entire system. The operation of the pump control circuit 40 is described in detail later.

A separate throttle is provided for each pump. Throttles 32, 34 and 36 respectively are provided for the pumps 12, 14 and 16. The throttles are normally installed on a console located at a certain distance away from the pumps at a place that is convenient to the operator who is controlling the operation of the pumps. A separate speed control circuit is operatively coupled to each pump. And each speed control circuit is operatively coupled to the pump control circuit 40. Speed control circuits 72, 74 and 76 respectively are associated with the pumps 12, 14 and 16. High voltage variable speed d.c. motors (not shown) are typically used as prime movers to operate mud pumps in the oil and gas industry. Silicon control rectifier ("SCR") based systems, commonly referred to in the industry as SCR drives or regulators, are frequently used to supply regulated d.c. power to the motors. In the present invention, SCR regulators are preferably used as speed control circuits when d.c. motors are used as prime movers. The pump control circuit 40, in response to the information provided by the position sensors, provides control signals to the speed control circuits to independently control the speed of each pump.

A separate bypass switch for each pump is provided at the pump control circuit 40. Bypass switch 42 is associated with pump 1(12), switch 44 with pump 2(14) and switch 46 with pump 3(16). When the bypass switches are closed, as shown in FIG. 1, they do not affect the operation of the pump control circuit 40. However, when a particular bypass switch is open, the pump control circuit merely passes the signal from the throttle associated with that pump directly to its associated speed control circuit, which means that the operator can manually control the operation of that pump. Obviously, when all bypass switches are open, the entire system is controlled manually. The pump control circuit 40 is connected to pump speed indicators 82, 84 and 86, which respectively indicate the speed (strokes per minute) of the pumps 12, 14 and 16. A device 90 is coupled to the pump control circuit 40, which indicates the fluid volume per unit time being pumped by all the operating pumps.

In short, the system of the invention as shown in FIG. 1 contains a pump control circuit 40 for controlling the operation of multiple pumps, each pump having an associated throttle, position sensor, speed control circuit, speed indicator and a bypass switch. The overall "control circuit" includes the pump control circuit 40 and the various speed control circuits and is designated by numeral 70.

Before describing further the mode of operation of the system shown in FIG. 1, it is considered helpful to first describe the operation of a typical prior art system. In the prior art, the throttles, such as throttles 32, 34 and 36, are coupled directly to the SCR regulators. An operator determines the desired amount of the mud to be pumped into the well and then determines the number of pumps to be run and their respective speeds. The operator then turns on one of the pumps (the first pump) and slowly increases its speed by adjusting the associated throttle until that pump reaches the desired speed. The operator then repeats this process for each of the desired number of the remaining pumps until the speeds of those pumps have been set as nearly the same as can be done manually. As indicated earlier, to minimize the pressure ripple at the output of the operating pumps, it is most desirable to operate all the pumps at exactly the same speed and with the same phase shift between any two successive piston strokes. In practice, however, it is generally not possible to manually set all the pumps to operate at exactly the same speed, much less controlling the phase shift among the strokes of the pistons of different pumps.

Referring back to FIG. 1, the system of the present invention operates each pump at a desired speed and with a desired phase shift among the piston strokes of the various pumps. In the present invention, the signals from the throttles 32, 34 and 36 are first passed to the pump control circuit 40. The mode of operation for a two pump system will now be described. To start the pumps, the operator closes the bypass switches associated with those pumps which are to be controlled by the pump control circuit 40. The operator then turns on both the pumps and adjusts only the throttle of the first pump (the master pump), for example throttle 32, until the speed indicator 82 shows the desired speed for pump 12. The pump control circuit 40 passes the signal from the first throttle 32 directly (unhibited) to the speed control circuit 72, which, in response to the throttle signal, adjusts the amount of d.c. power to the d.c. motor associated with the pump 12 to cause the pump to operate at the desired speed.

When the operator has increased the speed of the first pump 12 (the master pump) to a certain level, for example, fifteen percent (15%) of the maximum pump speed, the pump control circuit 40, utilizing the information obtained from the sensor signals, starts providing control signals to the second speed control circuit 74, which, in turn, starts adjusting the speed of the second pump 14 (the slave pump).

The pump control circuit 40, in response to the signals from the position sensors 52 and 54, causes the speed control circuit 74 to adjust the speed of the second pump 14 until the phase shift between the signals received from the sensors 52 and 54 equals a predetermined value. In other words, the stroke of a piston of pump 2 (14) follows the stroke of a piston of pump 1 (12) by a predetermined time period or phase shift. The pump control circuit 40 continually continues to monitor and adjust the speed of the second pump to maintain the desired phase shift between the piston strokes of these two pumps. It should be obvious that by merely controlling the phase shift, the pumps may be operated at exactly the same speed (zero beat frequency) with a desired phase shift between the strokes of the pistons of the pumps.

In a two pump system wherein each pump has three cylinders, the most even pressure in the manifold 20 is obtained when the phase shift between successive piston strokes in a pump system cycle is sixty degrees (60°). This is because there are a total of six cylinders in the system (three for each pump) and each pump system cycle consists of three hundred sixty degrees (360°).

When it is desired to use three pumps, the pump control circuit 40 controls the second and third pumps (the slave pumps) and adjusts the speed of those pumps until the phase shifts among the signals from the position sensors 52, 54 and 56 are at predetermined values. As it will be obvious, with a three pump system, wherein each pump has three (3) pistons, the most even pressure at the common pressure outlet 20 is obtained when the phase shift between successive piston strokes is forty degrees (40°).

The pump control circuit 40 may easily be programmed to start the slave pumps in any desired order. The pump control circuit may also be programmed to start some or all of the slave pumps at the same time. For example, in the three pump system described above, the second pump and third pumps (the slave pumps) may be started simultaneously when the first pump (the master pump) is started or when the first pump has achieved a predetermined speed or when a certain time has elapsed since the starting of the first pump or in a sequential manner.

As noted earlier, speed meters 82, 84 and 86 are coupled to the control circuit 40 to provide visual indication of the actual speed of each pump. The pump control circuit 40 counts the number of piston strokes per unit time of each pump and provides appropriate signals to the speed meters, which indicate the speed of their associated pumps. Alternatively, the speed meters may be calibrated to indicate the speed in pump cycles per unit time or in any other useful units. If a pump breaks down or is not programmed to be turned on, the corresponding speed meter will show zero speed. If a pump is programmed to be turned on but the corresponding speed meter indicates zero speed, an alarm may be provided to indicate a failed pump situation . The pump control circuit 40 may also be programmed to compute the volume of the fluid being pumped by each pump and/or by some or all of the operating pumps. To compute the fluid volume, the pumping capacity of each cylinder is programmed into the pump control circuit 40. The pump control circuit 40 utilizes that information and the number of strokes per unit time to determined the fluid volumetric output and displays it on the device 90.

Although the present invention is described for a system in which pumps have equal number of pistons, it should be obvious that the invention is equally applicable to multi-pump systems in which pumps have different number of pistons. Merely, controlling the phase shift between the piston strokes of the operating pumps ensures that the pumps are operating at desired speeds and phase shifts. Thus, the system of the present invention may be utilized to synchronize the pumps and/or to operate the pumps with the desired phase shift between the strokes of the master pump and slave pumps.

The effect on the common fluid pressure in the manifold, when the pumps are operating according to the present invention, will now be described while referring to FIGS. 2A–2D. These figures show normalized pressure in the manifold 20 as a function of time or speed for various conditions. The normalized pressure in the manifold 20 is shown along the vertical axis while time or speed in seconds is shown in the horizontal direction. For the purpose of illustration only and not as a limitation, each pump is assumed to contain three pistons. Therefore, the phase shift between successive strokes of the pistons of the same pump is 120 degrees.

Figure 2A:
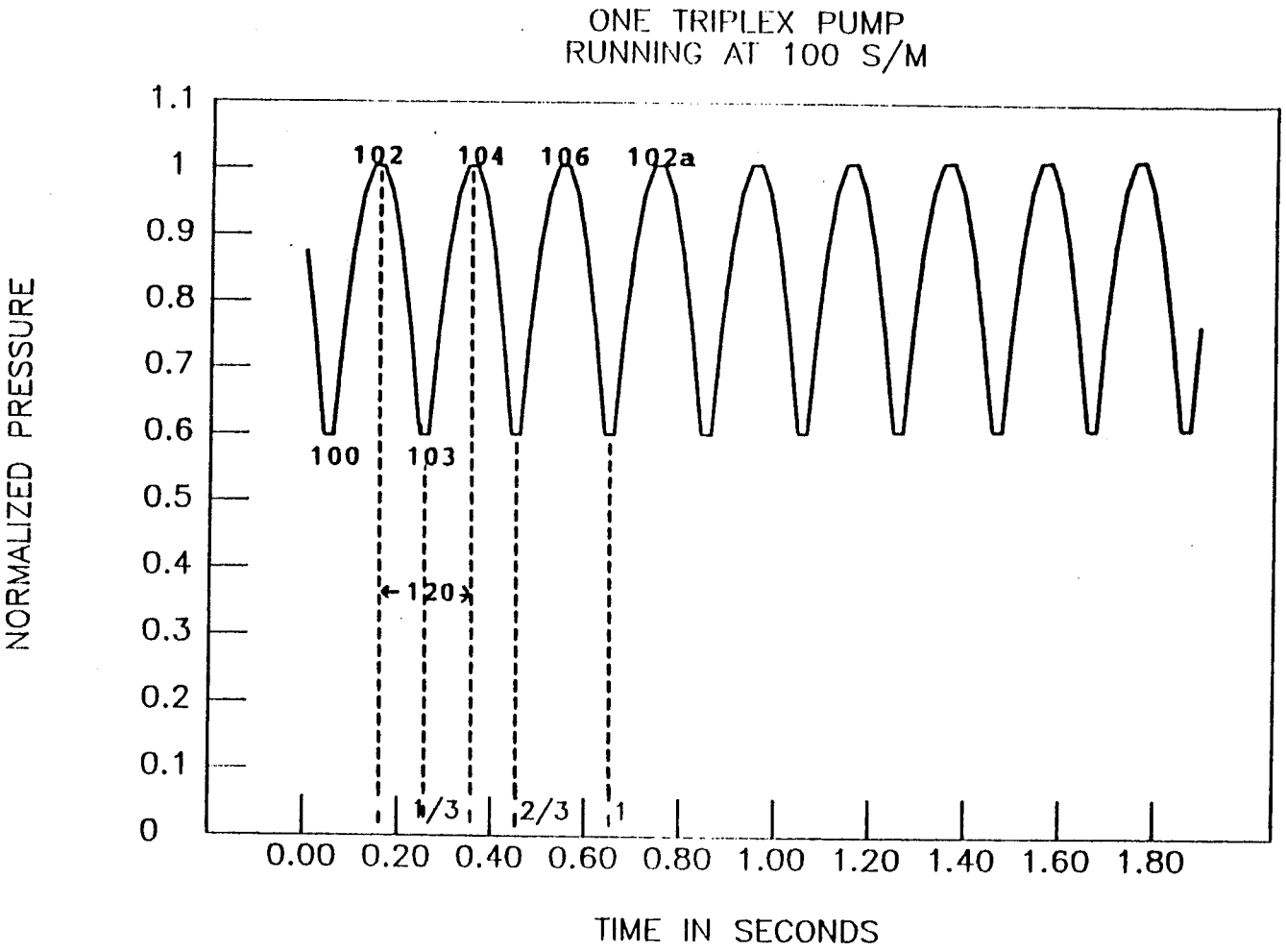
FIG. 2A Shows the normalized fluid pressure as a function time at the output of one pump.

In FIG. 2A, the plot 100 shows the normalized fluid pressure in the manifold 20 when only one pump is operating. The pressure in the manifold 20 rises due to the increased pressure exerted by the first piston of the pump until it reaches a local maxima at point 102. The local maxima occurs at a point when the first piston attains its maximum linear velocity. The pressure then decreases to a low point 103 and then starts to rise until the next local maxima occurs at point 104 when the second piston attains its maximum linear velocity. Similarly, point 106 represents when the third piston is at its peak linear velocity. Point **102*a* represents the pressure when the first piston is again at its peak velocity, thereby starting the cycle over. It should be noted that the pressure difference between the high points 102, 104 or 106 and the low points 103, 105 or 107** is about 0.5 on the normalized scale, i.e., fifty percent (50%) of full scale. The phase shift between the successive strokes of the pistons is 120 degrees.

Figure 2B:
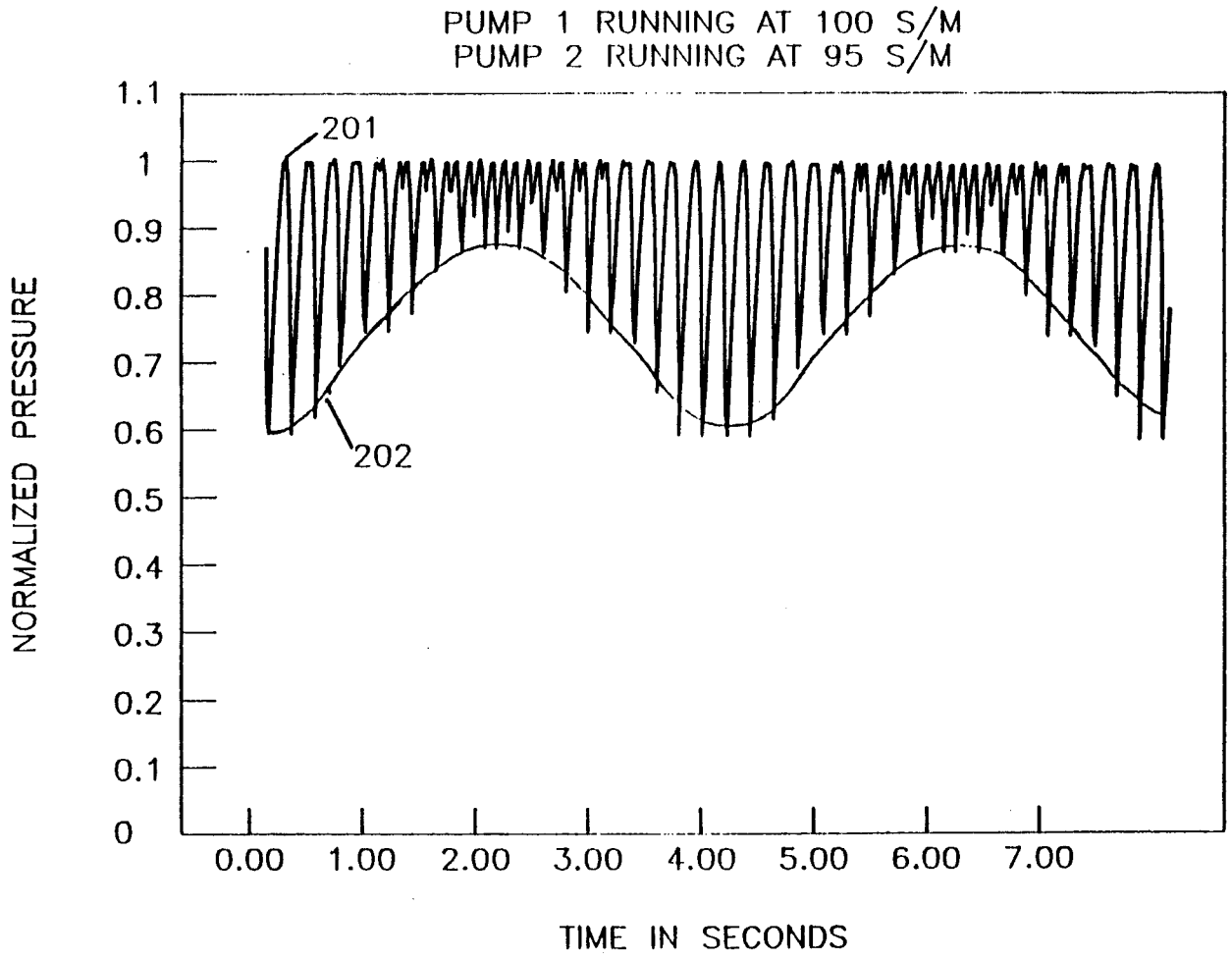
FIG. 2B Shows the normalized fluid pressure as a function of time at the common output of two three cylinder pups operating with a beat frequency of fifteen strokes per minute.

Line 201 in FIG. 2B shows the normalized pressure when two pumps are running with a five cycles (or fifteen strokes) per minute speed difference between them. Line 202 shows the frequency of the envelope, which is commonly referred to as the beat frequency. In the present example, the beat frequency is fifteen cycles per minute. There exists large pressure variance (pressure ripple) in the manifold 20 between the high pressure point and the low pressure point of the envelope , which as noted earlier can damage or greatly reduce the working lives of the pumps and other related components.

Figure 2C:
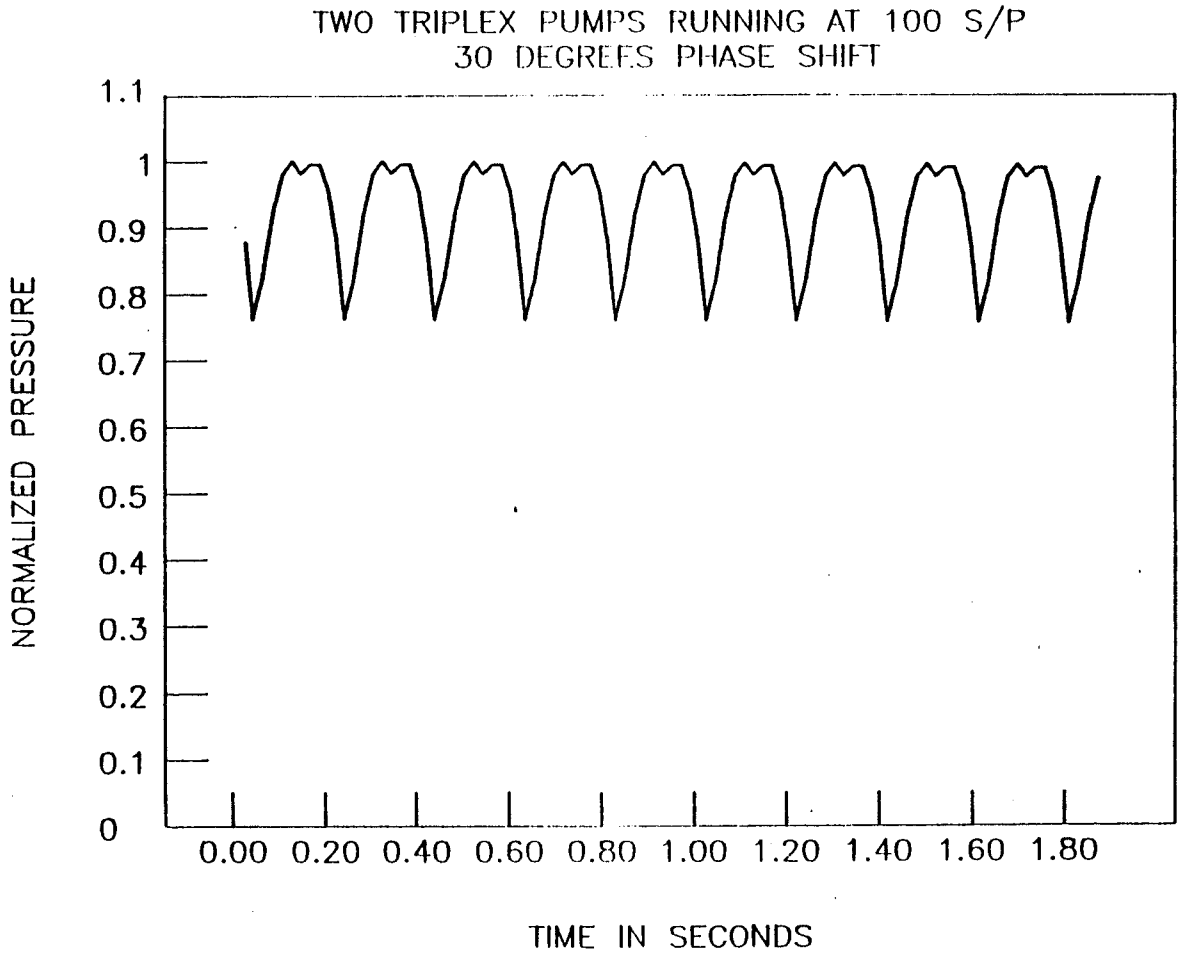
FIG. 2C Shows the normalized fluid pressure as a function of time at the common output of two three cylinder pumps operating at the same speed and with a thirty-degree (30°) phase shift between their piston strokes.

FIG. 2C shows the pressure in the manifold 20 when two pumps, each having three cylinders, are running at exactly the same speed but with thirty degree phase shift between the strokes of a piston of the first pump and the next succeeding stroke of a piston of the second pump. In this case, the pressure ripple is smaller than for a single pump and the beat frequency is zero.

Figure 2D:
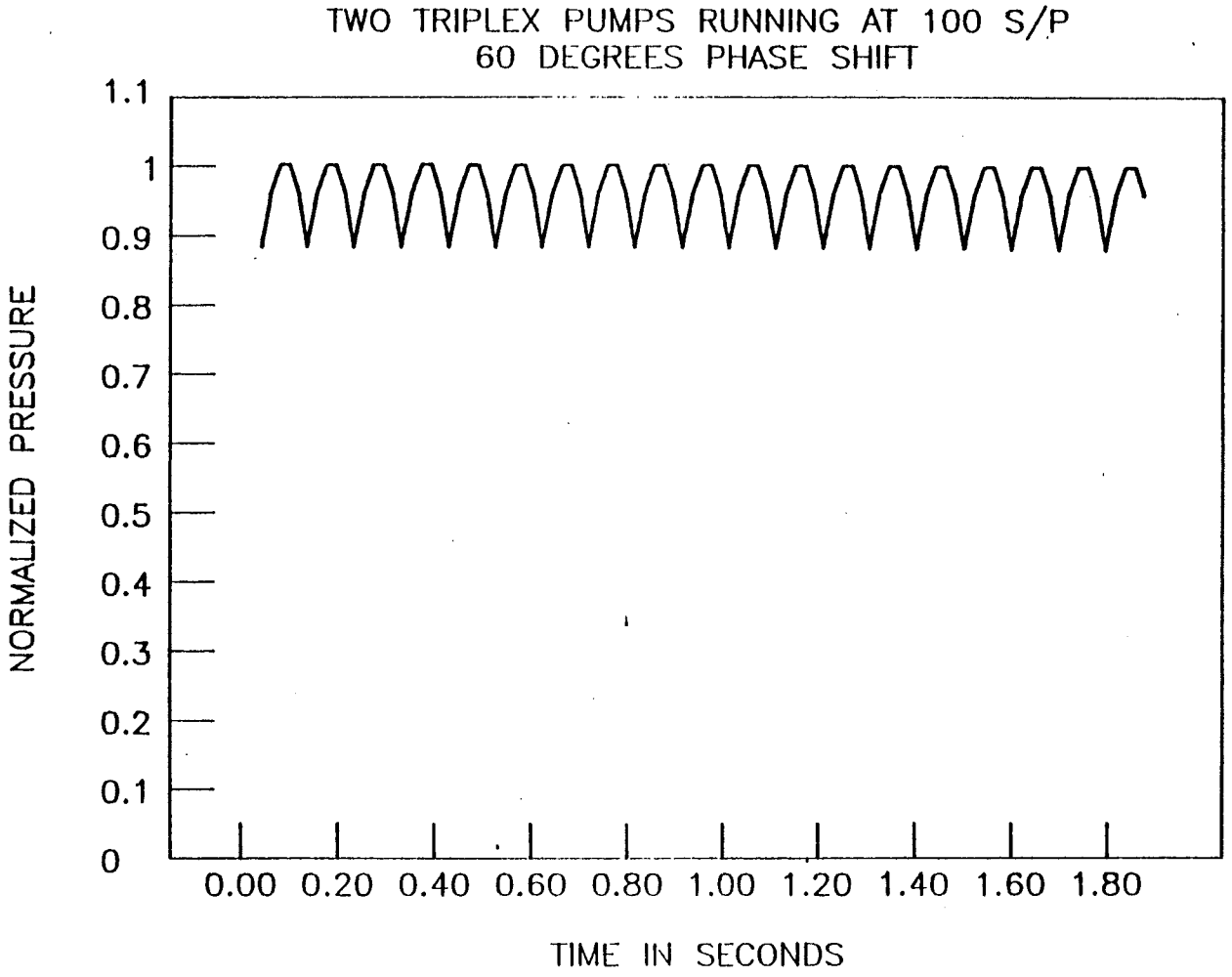
FIG. 2D Shows the normalized fluid pressure as a function of time at the common output of two three cylinder pumps operating at the same speed and with a sixty-degree (60°) phase shift between their piston strokes.

FIG. 2D shows the least pressure variance in the manifold pressure for a system using two pumps wherein each pump has three cylinders. The least pressure ripple occurs when both pumps are running at exactly the same speed with exactly the same phase shift (sixty degrees) or time delay between successive piston strokes.

The pump control circuit 40 is normally programmed or set to operate the pumps at the same speed and at desired phase shifts between the strokes of different pumps. When the pumps are set to operate at exactly the same speed, the beat frequency is eliminated. However, when the pumps are operated with the same phase shift between successive strokes, the pressure fluctuations (ripple)s at the manifold are the least, as shown in FIG. 2D.

It should be noted that FIGS. 2A–2D merely show specific examples when two pumps, each having three pistons, are used. The, present invention is, however, not limited to those specific situations. The present invention may be used with any number of pumps, whether the pumps have the same or different number of cylinders. And the system may be programmed to provide minimum pressure ripple at the common pressure outlet (manifold) for any configuration of the pumps.

Figure 3:
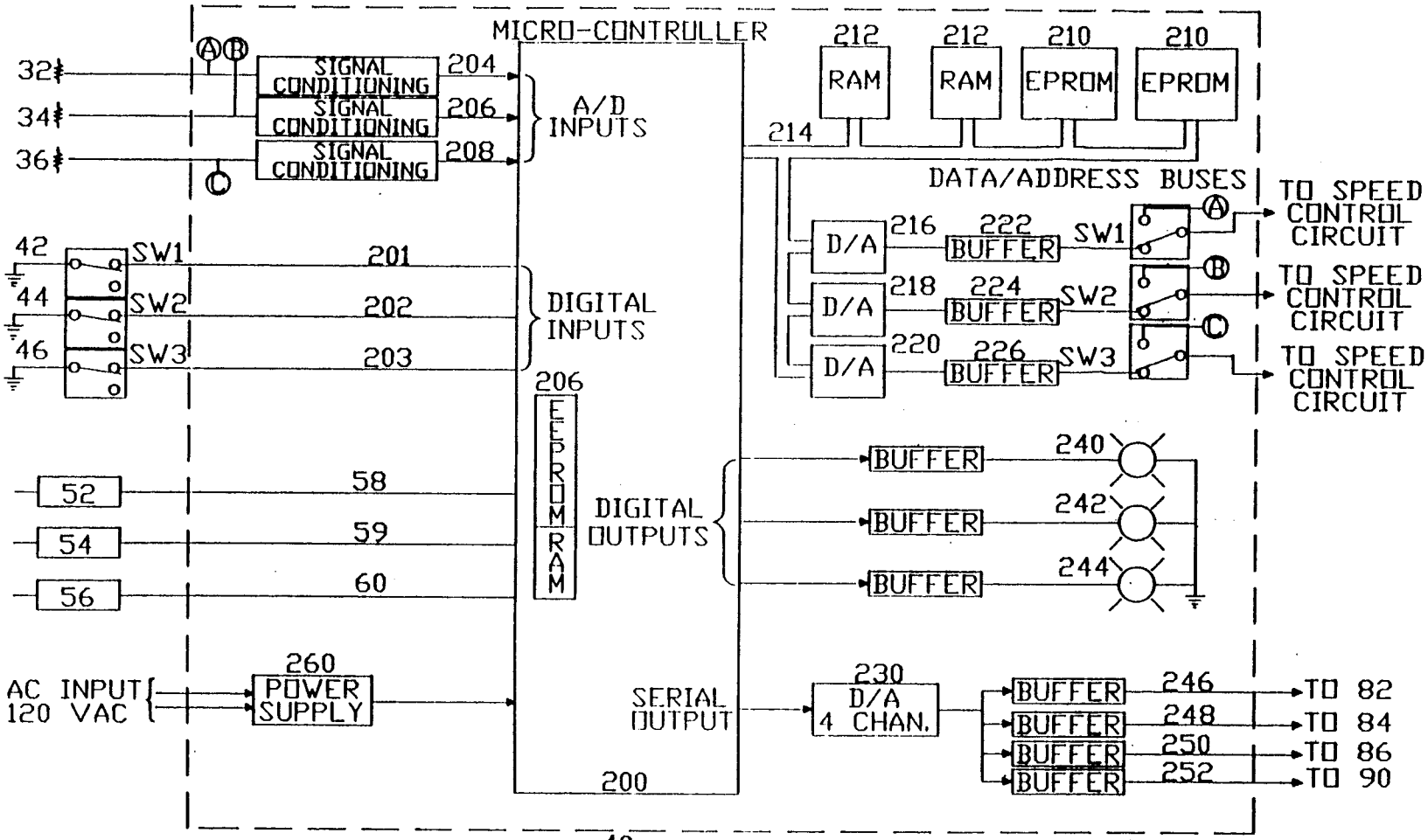
FIG. 3 Shows a digital circuit block diagram of the pump control circuit of FIG. 1.

FIG. 3 Shows the functional block diagram of one implementation (microcontroller based digital circuit) of the pump control circuit 40 of FIG. 1. The detailed operation of the circuit shown in FIG. 3 will now be described while referring to FIGS. 1 and 3. For convenience and to be consistent with the system of FIG. 1, and not as a limitation, the block diagram of FIG. 3 is shown for a three pump system. The pump control circuit 40 contains a microcontroller 200, which forms the essential part of the circuit and controls the operation of the entire system. To start the system, the operator decides which pumps are to be controlled by the pump control circuit 40 and accordingly closes the bypass switches associated with those pumps. For the purpose of illustration, all of the bypass switches 42, 44, and 46 are shown to be closed in FIG. 3. Closing of the bypass switches allows control signals to pass on lines 201, 202 and 203, which enable the microcontroller 200 to control the operation of the corresponding pumps.

The analog signals from the throttle 32, 34, and 36 are respectively passed through separate signal conditioners 204, 206 and 208. The signal conditioners filter the noise from the throttle signals and scale the signals to levels that are acceptable to the microcontroller 200. The conditioned signals are passed to the microcontroller where they are converted into digital signals. Analog signals generated by each of the position sensors 52, 54 and 56 are fed to the microcontroller 200 via lines 58, 59 and 60 respectively. The microcontroller 200 digitizes these signals, stores the digitized signals in a memory for use in controlling the operation of the system.

The microcontroller contains internal memory 206 for storing certain instructions and data. External memory in the form of ROMS or EPROMS 210 for storing programmed instructions or software and in the form of RAMs for storing data are coupled to the microcontroller 200 via a data buss 214.

During operation, the microcontroller 200 continually monitors the throttle signal respecting the master pump set by the operator and the signals from the position sensors. The microcontroller 200, in accordance with the instructions stored in both the internal and external memories, determines the phase difference between the sensor signals and provides control signals for each of the slave pumps to a separate D/A converter. For example, the control signal for the pump 12 is passed to the D/A converter 216, for pump 14 to the D/A converter 218 and for the pump 16 to the D/A converter 220. Each D/A converter converts the control signals to analog signals and feeds them to the corresponding speed control circuit via an associated buffer 222, 224 or 226. Each speed control circuit, in response to the control signal received from its corresponding buffer, adjusts the speed of its associated pump. The control signals generated by the microcontroller are such that they cause the speed control circuits to adjust the speeds of their respective pumps so that the phase shifts between the sensor signals are maintained at desired values. These predetermined phase shift values are programmed into the pump control circuit 40 and may easily be changed.

The microcontroller 200 also determines the speed (strokes per minute) for each pump and provides representative signals to a D/A converter 230, which converts those signals into corresponding analog signals. The analog signals indicative of the pump speeds are supplied via separate buffers to the speed meters 82, 84, and 86, which indicate the speed of their associated pumps. The microcontroller determines the total fluid volume being pumped from the speed and the volumetric capacity of each pump and provides a signal representative of the total fluid volume to a volumetric meter 90 via the D/A converter 230 or the like and a buffer 252. The volumetric meter 90 indicates the volume of the fluid being pumped per unit time.

It should be noted that the general design and operation of circuits utilizing microcontrollers or microprocessors, D/A converters, A/D converters, buffers and signal conditioners are well known in the art of electrical engineering. Discrete digital circuits may easily be used instead of the microcontroller based circuit as shown in FIG. 3 without departing from the scope and spirit of the invention. The design of circuit utilizing discrete digital circuits is also well known in the art.

Analog circuits, instead of the microcontroller or microprocessor based circuits are quite frequently utilized in the oil and gas industry even though state of the art circuits usually utilize digital electronics. Therefore, an analog implementation of the pump control circuit 40 is shown in FIG. 4.

Figure 4:
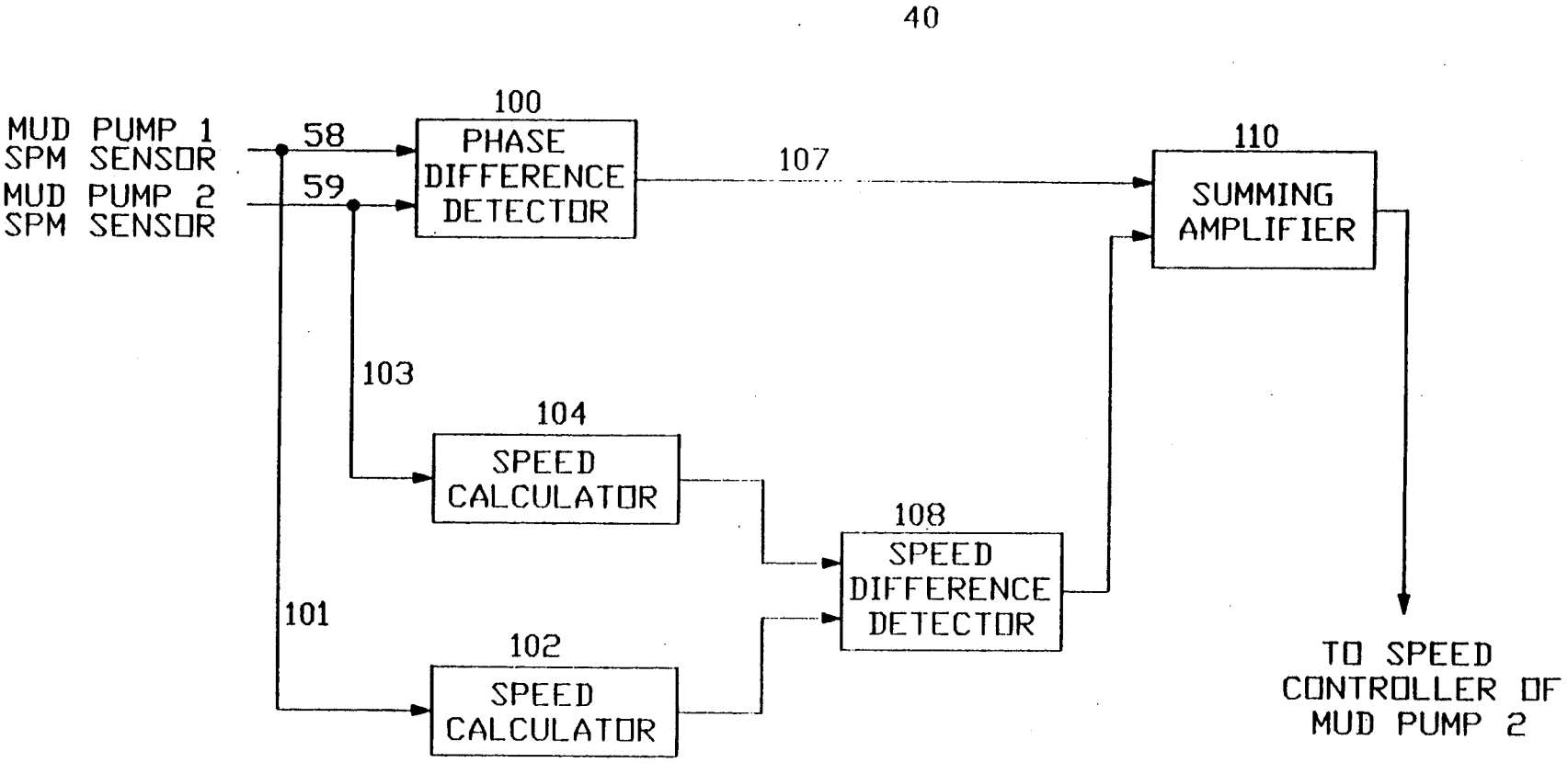
FIG. 4 Shows an analog circuit block diagram of the pump control circuit of FIG. 1.

For convenience and simplicity, and not as a limitation, the block diagram of FIG. 4 is shown for a two-pump system. It should be noted that the system shown in FIG. 4 can easily be extended to a system having more than two pumps.

The detailed operation of the pump control circuit 40 will now be described while referring to FIGS. 1 and 4. Signals from the position sensor 52 are passed via the conductor 58 to a phase difference detector 100 and to a speed calculator 102 via a conductor 101. Similarly, signals from the position sensor 54 are passed to the phase difference detector 100 via a conductor 59 and to a separate speed calculator 104 via a conductor 103. The phase difference detector computes the phase difference between the signals from the first and second position sensors and provides a phase difference signal via a conductor 107 to a summing amplifier 110. The outputs from both of the speed calculators 102 and 104 are passed to a speed difference detector 108, which determines the difference in the speeds, if any, between the two pumps 12 and 14. The output from the phase difference detector 100 is fed to the summing amplifier 110. The summing amplifier 110 provides a control signal that is a function of the speed difference and the phase difference to the speed control circuit 74, which adjusts the speed of the second pump 14 (the slave pump). The control circuit 74 causes the speed of the second pump 14 to increase or decrease until the phase shift between the signals received from the position sensors 52 and 54 equals a predetermined value.

While a particular embodiment of the present invention has been shown and described, it will be understood that the invention is not limited thereto, since many modifications and changes may be made without departing from the scope or the spirit of the invention. It is intended that all such variations, modifications and changes be part of this invention and that the present invention as disclosed herein is limited only by the following claims.

What is claimed is:

1. A system for pumping a fluid into a common pressure outlet, comprising:

(a) a plurality of pumps, each pump having a plurality of cylinders, each said cylinder having an associated piston adapted to reciprocate in its associated cylinder for pumping the fluid into the common pressure outlet;

(b) a separate speed control circuit coupled to each of the pumps in said plurality of pumps for independently controlling the speed of each said pump;

(c) a separate sensor coupled to one cylinder of each of the pumps, each said sensor providing a signal when the piston in the cylinder to which that sensor is coupled is at predetermined location; and (d) a pump control circuit coupled to each said speed control circuit and each said sensor, said pump control circuit receiving the signals from each of the sensors and in response thereto causing the speed control circuit to synchronize the speeds of the pumps and to maintain desired phase shifts among the sensor signals from the different sensors.

2. The apparatus as defined in claim 1, wherein each said speed control circuit is a silicon control rectifier based circuit which is adapted to supply regulated d.c. power for independently controlling the speed of its associated pump.

3. The apparatus as defined in claim 1, wherein said plurality of pumps consists of three pumps, each pump having three cylinders.

4. The apparatus as claimed in claim 1, wherein said desired phase shift is about forty degrees (40°).

5. The apparatus as defined in claim 1, further comprising a volume indicator coupled to the pump control circuit for displaying the fluid volume per unit time being pumped by all of the pumps.

6. An apparatus for pumping a fluid, comprising:

(a) a plurality of pumps;

(b) a separate sensor associated with each pump in said plurality of pumps, each sensor providing signals indicative of the operating cycle of its associated pump; and (c) a control circuit coupled to each of the sensors for receiving the signals therefrom, said control circuit in response to the received signals synchronizing the speeds of a desired number of pumps in said plurality of pumps and maintaining desired phase shifts between the signals.

7. A pump system, comprising:

(a) a plurality of pumps, each said pump having a plurality of cylinders, each said cylinder containing a reciprocating piston therein for pumping fluid from a source to a common pressure outlet;

(b) a separate electric motor coupled to each said pump, the speed (revolutions per unit time) of each said motor determining the speed (cycles per unit time) of its associated pump;

(c) a speed control circuit coupled to each said motor, said speed control circuit adapted to independently and controllably supply electric power to each said motor;

(d) a separate sensor coupled to one cylinder of each said pump, each said piston sensor providing an electrical signal each time the piston in the cylinder in which the sensor is installed is at a predetermined position; and (e) a pump control circuit coupled the speed control circuit and to each said sensor, said pump control circuit receiving said electrical signals from each said sensor and in response thereto causing the speed control circuit to adjust the electric power to each said motor so as to operate all the pumps at the same speed while maintaining a predetermined displacement angle among the signals from the sensors.

8. The apparatus of claim 7, wherein each said motor is a d.c. motor and said speed control circuit contains silicon control rectifier based circuit for independently supplying d.c. power to each said motor.

9. The apparatus of claim 7 further comprising a separate speed meter for indicating the speed of each of the pumps in said plurality of pumps, each said speed meter being coupled to and controlled by the pump control circuit.

10. The apparatus of claim 7, wherein the pump control circuit contains a micro-controller and a memory for storing instructions and data.

11. The apparatus of claim 10, wherein the micro-controller is programmed to compute the speed of each of the pumps in the plurality of pumps.

12. An apparatus for controlling the operation of a multiple pump system, each pump containing a plurality of cylinders, each cylinder containing a reciprocating piston therein for pumping fluid from a source to a common pressure outlet, a separate sensor coupled to one cylinder of each said pump for providing a signal each time the piston in such cylinder is at a predetermined place, each said pump coupled to and driven by a separate motor, the speed (revolutions per unit time) of each said motor determining the speed (strokes per unit time) of its associated pump, said apparatus comprising:

(a) a speed control circuit adapted to couple to each said motor for independently supplying power to each said motor for independently controlling the speed of each said motor;

(b) a pump control circuit coupled to the speed control circuit, said pump control circuit adapted to couple to each said sensor for receiving said signals from each said sensor, said pump control circuit in response to the sensor signals causing the speed control circuit to independently adjust the speed of each said motor so as to operate all the pumps in said plurality of pumps at the same speed while maintaining a predetermined displacement angle among the signals from the sensors.

13. The apparatus of claim 12, wherein the displacement angle is forty degrees.

14. The apparatus of claim 12, wherein the displacement angle is thirty degrees.

15. The apparatus of claim 12, wherein the displacement angle is sixty degrees.

16. The apparatus of claim 12, wherein each motor is a d.c. motor and the speed control circuit contains silicon control rectifier circuits for independently supplying d.c. power to each said motor for controlling the speed of each such motor, thereby independently controlling the speed of each said pump and maintaining the desired displacement angle among the sensor angles.

17. The apparatus of claim 12, wherein the pump control circuit further contains:

(i) a micro-controller;

(ii) a memory coupled to the micro-controller for storing information therein for use by the micro-controller, said micro-controller receiving signals from each said sensor and in response thereto and in accordance with the instructions stored in the memory producing a separate digital signal for controlling the speed of each said motor; and (iii) a separate digital-to-analog converter for converting each said digital signal into a corresponding analog signal, each said analog signal passing to the speed control circuit, said speed control circuit in response to each said analog circuit adjusting the power supply to a corresponding motor, thereby controlling the speed of such motor.

* * * * *